United States Patent [19]

Dallin, II

[11] Patent Number: 4,839,569

[45] Date of Patent: Jun. 13, 1989

[54] METHOD AND APPARATUS FOR PROVIDING GAIN CONTROL FOR AN IMAGE INTENSIFIER TUBE

[75] Inventor: William M. Dallin, II, Dallas, Tex.

[73] Assignee: Varo, Inc., Garland, Tex.

[21] Appl. No.: 129,997

[22] Filed: Dec. 8, 1987

[51] Int. Cl.[4] ..... H01J 29/52

[52] U.S. Cl. ..... 315/383; 250/213 VT; 313/532; 358/219

[58] Field of Search ..... 313/528, 532, 544, 103 R; 315/383; 358/219; 250/213 VT

[56] References Cited

U.S. PATENT DOCUMENTS

| | | | |
|---|---|---|---|
| 3,612,762 | 10/1971 | Wuellner et al. | 358/219 |
| 4,025,955 | 5/1977 | Grallien et al. | 358/219 |
| 4,710,675 | 12/1987 | Stephenson | 313/532 |

*Primary Examiner*—Theodore M. Blum

*Attorney, Agent, or Firm*—Baker, Mills & Glast

[57] ABSTRACT

A photocathode current sensing circuit (58) is provided to adjust the electron accelerating voltage to a cone (32) and a phosphor screen (34) on an image intensifier tube (26). The voltage is adjusted by an anode power supply (60) which is responsive to the photocathode current sensing circuit (58). As light strikes the photocathode (28), a current (56) is generated. The current (56) is directly proportional to the intensity of light striking the photocathode (28). As the light and the current (56) decrease, the sensing circuit (58) controls the power supply (60) to provide a higher voltage to the cone (32) and the screen (34). By increasing the voltage to the cone (32) and the screen (34) the electrons are provided with more acceleration and, therefore, are intensified for viewing on the screen (34). An increase in light operates oppositely and decreases the intensity on the screen (34).

22 Claims, 2 Drawing Sheets

METHOD AND APPARATUS FOR PROVIDING GAIN CONTROL FOR AN IMAGE INTENSIFIER TUBE

TECHNICAL FIELD OF THE INVENTION

This invention relates in general to image intensifier tubes, and in particular to a method and apparatus for providing gain control for an image intensifier tube.

BACKGROUND OF THE INVENTION

Image intensifier tubes are used to help an observer see objects under light conditions which would normally preclude vision. The first generation of image intensifier tubes utilizes a fiber optic cathode for receiving light and a fiber optic phosphorus screen for viewing. The screen is an anode which has a cone for focusing the light. As photons of light strike the cathode, the cathode surface generates electrons which are accelerated by a voltage applied across the gap between the cathode and the screen. The cone collects and focuses the electrons onto the screen where a light intensified image is viewed. To prevent the image from becoming too bright for human comfort, various circuits have been used to control brightness or gain.

One type of system which has been used to control gain is an automatic brightness control (ABC). To obtain automatic brightness control in a first generation tube, it was necessary to use an open loop scheme such as by using a soft power supply. When enough current passed through the tube, it caused the voltage to drop, and, therefore, the gain was reduced. The gain was not controlled, however, in an efficient and predictable manner.

Microchannel plates have been previously developed as an alternative to ABC in a second generation of image intensifier tubes. Microchannel plates are able to adjust gain in a closed loop circuit, but unfortunately, microchannel plates are expensive. Thus, a need has arisen for a method and apparatus to provide efficient gain control in an image intensifier tube without the expense of microchannel plates.

SUMMARY OF THE INVENTION

The present invention disclosed and claimed herein describes a method and apparatus for an image intensifier gain control for a first generation image intensifier which substantially eliminates problems associated with prior automatic brightness controls.

In accordance with one aspect of the present invention, an apparatus is provided for removing the stray current that is created within an image intensifier tube. In an image intensifier tube of the type having a cathode that emits electrons which are accelerated toward a screen by an applied voltage, stray current is generated within the tube by the applied voltage despite attempts to insulate the interior of the tube. To remove the stray current, the tube is constructed with a guard ring which is connected by a conductor to a ground potential.

In another aspect of the present invention, a sense amplifier circuit is utilized to sense the current in the cathode. The guard ring is provided to remove any leakage current that may be generated inside the image intensifier tube and prevent the leakage current from combining with the cathode current. Also, due to the sometimes very low levels of current at the cathode, it is necessary to remove the leakage current from the cathode current prior to being sensed by the sense amplifier circuit. Without removing this leakage current, the sense amplifier circuit would be unable to discriminate between the cathode current and the leakage current.

The guard ring is installed in the image intensifier tube as close to the cathode as possible. This allows the guard ring to draw off any leakage current prior to its entering the cathode and masking the lower cathode current. The guard ring is comprised of a conductor isolated by insulators inserted around the circumference of the tube proximate the tube cathode. The guard is grounded or biased at the cathode voltage at the sense amplifier circuit. The guard ring serves to draw off the leakage current prior to its being mixed with the cathode signal current.

BRIEF DESCRIPTION OF THE DRAWINGS

For a more complete understanding of the present invention and for further advantages thereof, reference is now made to the following detailed description taken in conjunction with the accompanying drawings, in which.

DETAILED DESCRIPTION OF THE INVENTION

Figure 1:
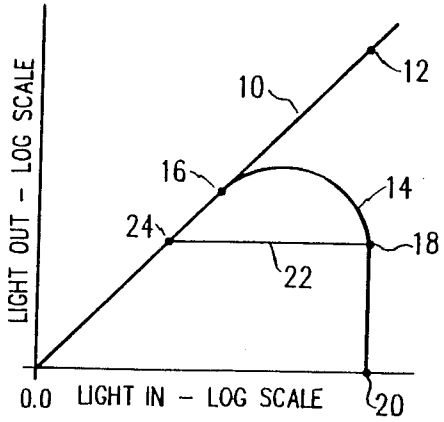
FIG. 1 is a graphic depiction of Light In versus Light Out in a typical image intensifier tube.

FIG. 1 graphically depicts Light Out on the vertical scale versus Light In on the horizontal scale, for a typical first generation image intensifier tube. The Light Out parameter represents the amount of light at the viewing portion of the image intensifier tube, and the Light In parameter represents the amount of light at the receiving, or input, portion of the image intensifier tube. Line 10 depicts the result of no brightness control, i.e. Light Out increases directly proportional to Light In. With no brightness control the Light Out would at some point, for example, point 12, become too bright for human eye comfort.

The line 14 depicts the voltage characteristics of a typical first generation intensifier tube soft power supply. At some point, for example, point 16, the Light Out starts to decrease as the Light In continues to increase. At another point, for example, point 18, the Light Out begins to drop off rapidly and eventually reaches 0.0 at point 20.

The line 22 depicts the preferred gain control response obtained with a closed loop, microchannel plate second generation intensifier tube. At some point, for example, point 24, the Light Out remains constant despite an increase in the Light In input to the device. At another point, for example, point 18, the circuit reaches bright source protection which is built into the circuit. The bright source protection prevents the output light from reaching point 12 by causing the screen to blacken. This prevents damage to the tube and possible harm to the operator. It is the objective of the present invention to provide a light response similar to the second generation tube response, but without the requirement of using expensive microchannel plates.

Figure 2:
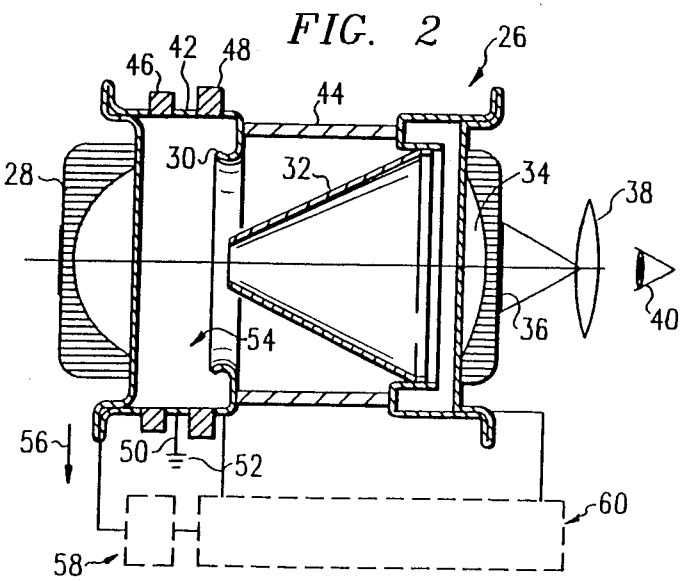
FIG. 2 is a cross section of a first generation intensifier tube in accordance with the preferred embodiment.

Referring to FIG. 2, there is shown the preferred embodiment of the present invention. An image intensifier tube is generally identified by the reference numeral 26. A photocathode 28 receives light reflected from an external source or object, not shown. Although not shown, it is to be understood that the tube 26 includes at least one optical lens prior to the cathode 28. The cathode 28 converts photons from the external source into electrons, as is well known in the art. The electrons are accelerated through a focus grid 30 and through an anode cone 32. The electrons then strike a phosphor screen 34, creating an inverted image 36. The inverted image 36 is reinverted by the lens 38 for viewing by an observer, as depicted by an eye 40 of the viewer.

The body of tube 26 is generally cylindrical in shape for supporting the various components in spaced apart relationships. In particular, the body of the tube 26 includes a conductive guard ring 42 insulated by insulators 46 and 48 from the other frame components of the tube. The guard ring 42 may be, for example, Kovar or stainless steel. Shown also is an insulator 44 for insulating the focus grid 30 from the frame part of the anode cone 32. The insulator 44 may be, for example, a ceramic material. The insulators 46 and 48 may be of the same ceramic material as the insulator 44. The insulators 46 and 48 are attached to both the body of the tube 26 and the guard ring 42 by any appropriate means, such as brazing. The guard ring 42 may be located anywhere along the body of the tube 26, but is preferably located as close to the cathode 28 as possible where the focus ring 30 is separated from the cathode 28. Where the focus ring 30 is one with the cathode 28, and referred to as the cathode aperture, then the guard ring 42 and an insulator should be placed in insulator 44 close to the cathode aperture.

A conductor 50 connected to a ground 52 is provided to draw off the leakage current, as indicated by the arrow 54, which may form within the tube 26. As noted above, the leakage current 54 is generated from the applied voltage employed to accelerate the electrons. The cathode current, as indicated by the arrow 56, is generated as a result of light striking the cathode 28.

The leakage current 54 is typically in the range of 2.5 nanoamps, whereas the cathode current 56 is typically in the range of only 0.1–0.5 nanoamps. Thus, since the leakage current 54 is significantly greater than the cathode current 56, the cathode current 56 would be masked by the leakage current 54 if such currents were not separated. Once the leakage current 54 is removed by the guard ring 42, the cathode current 56 may be separately coupled to the sense amplifier circuit 58. The sense amplifier circuit 58 regulates the anode power supply circuit 60, as will be discussed below. It is important to keep the guard ring 42 at the same reference voltage as the sense amplifier circuit 58 to prevent any voltage gradient. In the preferred form of the invention, the reference voltage is a ground potential.

Figure 3:
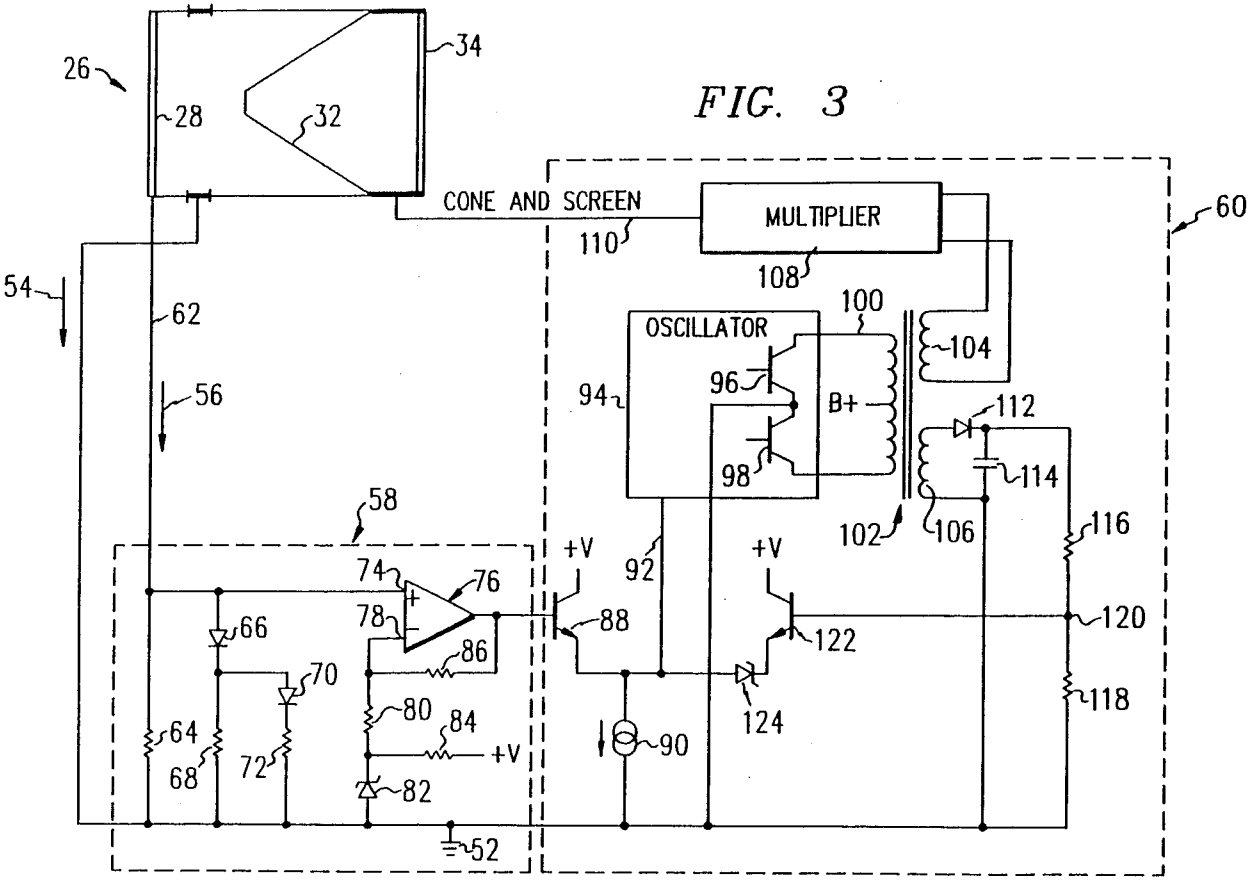
FIG. 3 is a diagram of the circuits for sensing cathode current and generating tube voltages in accordance with the preferred embodiment.

FIG. 3 illustrates the details of the sense amplifier circuit 58 for sensing cathode current 56, and the power supply circuit 60 for generating therefrom a voltage which is applied to the cone 32 and the screen 34 of the image intensifier tube 26. In those situations where the anode cone and screen require separate voltage, such voltages can be generated by the power supply circuit 60. In accordance with an important feature of the invention, the circuits of FIG. 3 are adapted for reducing the voltage applied to the anode cone 32 and screen 34 of the image intensifier tube 26 with increasing cathode currents 56. Thus, as the light intensity of the source to which the image intensifier tube 26 is exposed increases, the cathode current 56 also increases, whereupon the voltage applied to the anode cone 32 and screen 34 of the tube 26 is decreased in accordance with a predefined scheme by the illustrated sense amplifier circuit 58.

The cathode current sense amplifier circuit 58 comprises a circuit for generating a piecewise linear voltage in accordance with the present scheme. The cathode current 56 of the image intensifier tube 26 is carried by conductor 62 to the sensing circuit 58. The sensing circuit 58 includes a resistor 64 connected in parallel with a diode 66 connected in series with a resistor 68. Connected in parallel with the resistor 68 is yet another serial network, comprising a diode 70 and a resistor 72. The diodes 66 and 70 are conventional silicon diodes having forward threshold voltages of about 0.6 volts. Resistor 64 is larger in value than resistor 68, and resistor 68 is in like manner larger in value than resistor 72. Each resistor 64, 68 and 72 has one terminal thereof connected to a reference potential, such as ground 52. One terminal of resistor 64 is connected together with the anode of diode 66 to a noninverting input 74 of an amplifier 76. The inverting input 78 of amplifier 76 is connected through a resistor 80 to a reference voltage generated by a Zener diode 82. The Zener diode 82 is biased by a positive voltage +V supplying a current through a resistor 84. A feedback resistor 86 is connected between the output of the amplifier 76 and the inverting input 78 which, together with the value of resistor 80, determines the gain of the amplifier 76.

In the preferred embodiment, a gain of about ten is sufficient for carrying out the functions of the sense amplifier circuit 58. The output of the amplifier 76 is connected to a drive transistor 88 which is connected in a common emitter configuration to a constant current source 90. The emitter output of the drive transistor 88 is connected to a control input 92 of a voltage controlled oscillator 94. The voltage controlled oscillator 94 includes, among other conventional circuits, a push-pull output having a pair of transistors 96 and 98 for driving the primary 100 of a transformer 102 with alternating current signals. The transformer 102 includes a pair of secondary windings 104 and 106. The secondary winding 104 is effective to step up the voltage induced in it by the primary winding 100, and applies the increased voltage to a multiplier circuit 108. The multiplier circuit 108 further increases the magnitude of the voltage, and converts the same into a DC voltage which is connected to the cone 32 and screen 34 of the image intensifier tube via conductor 110.

The secondary winding 106 has connected thereto a rectifier diode 112 for providing half-wave rectification of the signals induced into the noted secondary winding 106. A capacitor 114 is connected across the diode 112 and the secondary winding 106 to filter the rectified AC signals and produce a DC voltage which varies in accordance with the AC output on the other secondary winding 104. Hence, the magnitude of the DC voltage across the filter capacitor 114 is related to the voltage applied to the cone 32 and screen 34 of the image intensifier tube 26. The DC output voltage generated from the secondary winding 106 is connected through divider resistors 116 and 118 to ground 52. The junction 120 of the resistor divider is connected to the base of a feedback transistor 122 for biasing purposes. The emitter of transistor 122 is connected through a 6.8 volt Zener diode 124 to the constant current source 90. The connection of the transistors 88 and 122 to the constant current source 90, as well as to the oscillator control input 92, provides an analog OR function. By connecting the transistor 122 as such to the control input 92 of the voltage controlled oscillator 94, a predefined operating point of the voltage controlled oscillator 94 can be established. More particularly, a predefined AC output voltage generated across the secondary winding 104 can be established by selecting the values of divider resistors 116 and 118 to thereby bias the transistor 122 at an operating point to establish a voltage at the control input 92 of the voltage controlled oscillator 94, thereby producing the predefined voltage at the secondary winding 104.

The operation of the power supply circuit 60 of the image intensifier tube 26 will be described in terms of a light intensity which increases as it strikes the photocathode 28. In operation, the cathode current 56 resulting from the photons striking the photocathode 28 is carried by the conductor 62 to the sensing circuit 58. For small cathode currents 56, neither diode 66 nor 70 are forward biased, and thus such cathode currents 56 flow only through resistor 64, thereby developing a voltage at the noninverting input 74 of the amplifier 76. Cathode currents 56 which develope a voltage across resistor 64 substantially smaller than about 0.6 volts provide corresponding voltages to the noninverting amplifiér input 74. The 0.6 volt knee of the input characteristic curve of the sensing circuit 58 is arbitrary, and corresponds to the forward threshold voltage of the diode 66. Other thresholds can be achieved by using other types of diodes or other threshold devices. In any event, before the threshold voltage of diode 66 is reached, the point of conduction by resistor 64 is below the 0.6 volt knee.

For cathode currents which develop a voltage across resistor 64 somewhat greater than about 0.6 volts, diode 66 becomes forward biased, whereupon a shunt path is developed for the cathode current 56 around resistor 64. The shunt path comprises diode 66 and resistor 68. The combined parallel resistances of resistors 64 and 68 is smaller than either resistor alone. Resistor 68, being smaller in value than that of resistor 64, develops a smaller voltage at the noninverting input 74 of the amplifier 76. Hence, for larger cathode currents, due to increased light intensity, the voltage applied to the input of the amplifier 76 increases at a reduced slope.

For further increases in the cathode current 56, the voltage across resistor 68 exceeds the 0.6 threshold of the shunt diode 70, whereupon an additional shunt path comprising diode 70 and resistor 72 becomes effective. As a result, the resistance of the sensing circuit 58 is further reduced, thereby further reducing the input voltage slope to the amplifier 76. As can be appreciated, for increasing light intensities, and thus corresponding increases in the cathode current 56, the voltage input to the amplifier 76 increases in a piecewise linear manner. In the disclosed embodiment, the piecewise characteristic of the sensing circuit 58 provides an amplifier input voltage characteristic which has an initially large positive slope, a breakpoint where the threshold voltage of diode 66 is reached, another leg with a reduced positive slope, another breakpoint where the threshold voltage of diode 70 is reached, and lastly another leg with yet a further reduced positive slope. While the foregoing describes the preferred embodiment of the sensing circuit 58, those skilled in the art will appreciate from the foregoing disclosure that many other circuits may be devised for reducing the voltage input to the amplifier 76 in response to increasing cathode currents 56.

The output of the amplifier 76 produces a representation of the voltage presented on its noninverting input 74, amplified by a gain factor. The output of the amplifier 76 thus increases in magnitude, in a piecewise linear manner, for increasing cathode currents 56. The output voltage of the amplifier 76 is applied to the drive transistor 88 for overriding the voltage on the control input 92 of the voltage controlled oscillator 94, as established by feedback transistor 122. As noted above, the voltage controlled oscillator 94 is of the type where the output voltage generated across the transformer primary 100 decreases with increasing voltages applied to its control input 92. Hence, as the output of the amplifier 76 increases in magnitude, the drive transistor 88 is driven further into conduction, thereby increasing the voltage on the control input 92 of the voltage controlled oscillator 94. Indeed, when the voltage on the control input 92 rises to a sufficient level, the Zener diode 124 becomes reverse biased, thereby effectively removing the feedback transistor 122 from influencing any control on the voltage controlled oscillator 94. This action occurs for light intensities beyond a prescribed amount.

As can be appreciated, with increasing cathode currents 56, the voltage generated across the primary 100 of the power transformer 102 does not increase in corresponding amounts, but rather decreases. Accordingly, the voltage developed across the secondary winding 104 is similarly reduced, thereby reducing the input voltage to the multiplier 108. As a result, the multiplier 108 produces a reduced output voltage on the conductor 110 which supplies the accelerating voltage to the cone 32 and screen 34 of the image intensifier tube 26.

Figure 4:
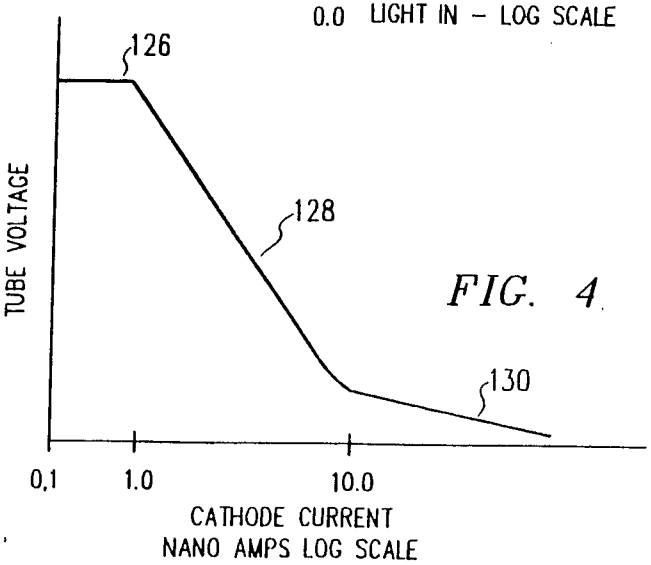
FIG. 4 is a graph depicting the tube voltage generated in response to cathode current in accordance with the preferred embodiment.

Referring to FIG. 4, a graphic illustration of the tube voltage versus the cathode current is depicted. As the cathode current increases, it is desired to decrease the voltage to the tube. For low cathode current levels (0.1 to 0.5 nanoamps) the tube voltage is maintained at a high level as shown by line 126. As the cathode current increase to the vicinity of 0.6 to 1.0 nanoamps the tube voltage begins to drop rapidly as shown by line 128. When the cathode current reaches the level of approximately 10 nanoamps, the tube voltage gradually approaches 0.0 as shown by the line 130 and the screen will eventually be blanked out. As noted, the cone and screen voltage is reduced in a piecewise linear manner in response to increasing photocathode currents.

Although the present invention has been described with respect to a specific preferred embodiment thereof, various changes and modifications may be suggested to one skilled in the art and it is intended that the present invention encompass such changes and modifications as fall within the scope of the appended claims. The principles and concepts of the invention may be applied to many types of devices, including minifier type tubes.

What is claimed is:

1. An improved apparatus for viewing objects under low light conditions, comprising:

a photocathode for emitting electrons when the low level light rays strike the photocathode;

a screen for receiving the electrons;

an anode cone for directing the electrons onto said screen;

a housing for supporting said photocathode, said anode cone and said screen;

an adjustable power supply voltage for accelerating the electrons from said photocathode to said screen;

a guard conductor in said housing proximate said photocathode and electrically isolated from said screen and said photocathode, said guard conductor utilized for removing tray current; and means for sensing a current generated by the light striking said photocathode and for adjusting the accelerating voltage in response to changes in the photocathode current.

2. The apparatus of claim 1, wherein said guard conductor further includes means for connecting said guard conductor to a ground potential.

3. The improved apparatus of claim 1, wherein said guard conductor comprises:

a first insulator proximates the photocathode;

a grounded insert portion attached to said first insulator; and a second insulator attached to said grounded insert.

4. The apparatus of claim 3, wherein said first and second insulators comprise a ceramic material.

5. The apparatus of claim 3, wherein said insert portion comprises stainless steel.

6. The improved apparatus of claim 1, wherein said means for sensing a photocathode current comprises a circuit for generating a piecewise voltage.

7. The apparatus of claim 6, wherein said circuit is responsive to increasing photocathode currents for producing correspondingly lower linear voltages.

8. The improved apparatus of claim 6, wherein said circuit includes an amplifier for amplifying said piecewise linear voltage, said amplifier producing a corresponding output voltage for use in generating said accelerating voltage.

9. A method for removing stray current generated within an image intensifier tube of the type having a photocathode emitting electrons which are accelerated by a voltage toward a screen, comprising the steps of:

separating a current generated by such photocathode from the stray current by insulating said photocathode from said screen with a guard conductor located proximate said photocathode;

removing said stray current such that it does not affect the operation of said tube; and generating an electron accelerating voltage in response to said photocathode current.

10. The method of claim 9, wherein said separating step further comprises grounding the guard conductor to draw off and remove said stray current.

11. The method of claim 9, further including generating said accelerating voltage in a nonlinear manner in response to said photocathode current.

12. A method for automatically controlling gain in an image intensifier tube of the type having a photocathode emitting electrons which are accelerated toward a screen by a voltage, comprising the steps of:

sensing a current generated by said photocathode;

varying said voltage for accelerating the electrons in response to said sensed photocathode current; and isolating said photocathode from said screen with an insulated guard conductor proximate said screen to prevent leakage current generated by said voltage from mixing with said photocathode current.

13. The method of claim 12, wherein the step of sensing a photocathode includes amplifying representations of said photocathode current.

14. The method of claim 12, wherein the step of isolating the photocathode from the screen further includes grounding said guard conductor.

15. Apparatus for automatically controlling gain in an image intensifier tube of the type having a photocathode emitting electrons which are accelerated toward a screen, comprising:

means for sensing a current generated by the photocathode;

means for adjusting a voltage for accelerating the electrons in response to said sensed photocathode current; and means for isolating the photocathode from the screen to prevent a leakage current generated by said voltage from mixing with said photocathode current.

16. The apparatus of claim 15 wherein said means for sensing a photocathode current includes an amplifier for amplifying representations of said photocathode current.

17. The apparatus of claim 16, wherein the means for sensing further includes a circuit for generating a piecewise linear voltage for input to said amplifier.

18. The apparatus of claim 17 wherein said piecewise linear circuit includes at least one threshold responsive device.

19. The apparatus of claim 18, wherein said circuit is operable to generate a characteristic curve having a break point for each said threshold device.

20. The apparatus of claim 15, wherein said means for adjusting a voltage includes a variable voltage supply responsive to the output of said means for sensing for providing changes in the voltage for accelerating the electrons.

21. The apparatus of claim 15, wherein said means for isolating the photocathode from the screen comprises:

an insert portion;

a first insulator separating said insert portion from said photocathode;

a second insulator separating said insert portion from the screen; and a ground connected to said insert portion such that said leakage current is drawn off prior to the photocathode.

22. The apparatus of claim 21, wherein said insert portion is positioned proximate the photocathode.

* * * * *